United States Patent [19]

Brodbeck

[11] 4,008,715

[45] Feb. 22, 1977

[54] MASSAGING AND RELAXING DEVICE

[76] Inventor: Brunhilde Brodbeck, 1440 Poplar Ave., Memphis, Tenn. 38104

[22] Filed: Dec. 2, 1975

[21] Appl. No.: 637,021

Related U.S. Application Data

[62] Division of Ser. No. 511,981, Oct. 4, 1974, Pat. No. 3,934,579.

[52] U.S. Cl. ..... 128/57

[51] Int. Cl.[2] ..... A61H 15/00

[58] Field of Search ..... 128/57, 24.3, 58, 67

[56] References Cited

FOREIGN PATENTS OR APPLICATIONS

| | | | |
|---|---|---|---|
| 237,191 | 12/1964 | Austria | 128/57 |
| 654,033 | 11/1928 | France | 128/57 |

*Primary Examiner*—Lawrence W. Trapp

*Attorney, Agent, or Firm*—Hill, Gross, Simpson, Van Santen, Steadman, Chiara & Simpson

[57] ABSTRACT

Muscle toning apparatus that can be used by one or more individuals to tone the muscles of a single person as passed back and forth under varying pressures, to relieve and stimulate tired muscles.

4 Claims, 3 Drawing Figures

MASSAGING AND RELAXING DEVICE

This is a division of application Ser. No. 511,981, filed Oct. 4, 1974 and now U.S. Pat. No. 3,934,579.

BACKGROUND, SUMMARY AND ADVANTAGES OF INVENTION

Muscle toning apparatus have heretofore been generally disclosed in such patents as the U.S. Pat. Nos. to Rohrer 1,014,774, Clarke 1,585,767 and Belleville 2,578,916, which operate on the principle of relieving tissue and muscle tension as passed back and forth along the body. While some of these tension relievers are particularly made to generally conform to parts of the body, they are mostly stiff and unwieldy and do not perform an efficient massaging operation.

The present invention improves upon the massaging devices of the foregoing references by providing a relatively flexible, freely movable relaxer or exerciser, which may conform to various parts of the body and perform a muscle toning or relaxing function without discomfort to the body.

An advantage of the present invention is that the relaxer is sufficiently flexible and freely movable to relax the body tissues and relieve tension by a slow toning motion along the desired parts of the body.

A further advantage of the invention is that the massaging device may readily relieve tension from various parts of the body by exerting a free rolling motion along the tense muscular portions of the body.

A still further advantage of the invention is that the apparatus and its operation is so simple and requires so little physical effort that it may be operated by a confined person, such as a semi-invalid.

A still further advantage of the invention is the provision of an exercising apparatus and device producing a vigorous kneading motion, stimulating the skin and underlying tissues without damage to the skin and, at the same time, producing a soft and relaxing massaging action to dispel tension or fatigue.

Still another advantage of the invention is to massage on the principle of kneading or massaging with beads or rollers and to arrange the kneading or massaging rollers and support therefor to make it easy to manipulate the rollers over the throat, neck and shoulder muscles and particularly at the base of the skull on the back of the neck.

A still further advantage of the invention is to provide a massaging device utilizing rotating beads to effect a massaging operation and to so size the beads as to avoid undesirable stretching of the skin and muscle tissue and to allow more pressure to be exerted where required over relatively long periods of time without discomfort.

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure.

DESCRIPTION OF THE PREFERRED EMBODIMENTS

Figure 1:
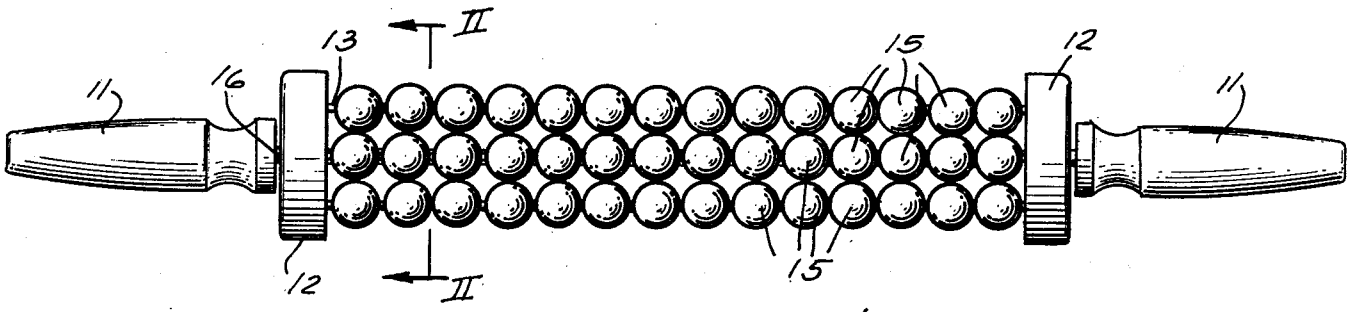
FIG. 1 is a diagrammatic view of a form of exerciser utilizing the principles of the present invention.
Figure 3:
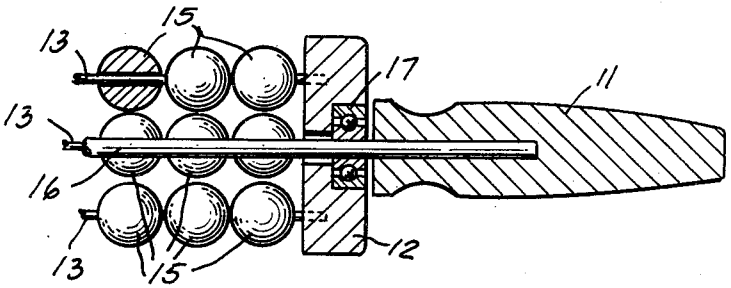
FIG. 3 is a fragmentary longitudinal sectional view of one end portion of the massaging device.
Figure 2:
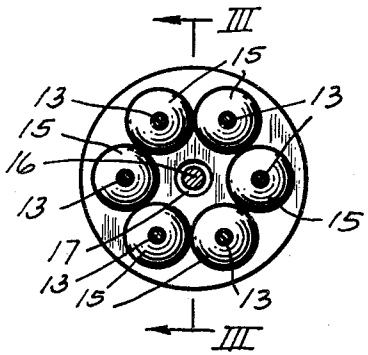
FIG. 2 is a sectional view taken substantially along line II—II of FIG. 1.

In the embodiment of the invention illustrated in FIG. 1 of the drawings, I have shown generally what may be termed a rolling-pin-type relaxer having handles 11 on each end of the relaxer on the outsides of disks 12 forming bearing supports for the handles and also forming supports for a series of parallel flexible pins 13 freely carrying massaging beads 15, shown as being balls, in side-by-side relation with respect to each other. While the massaging beads are shown as being generally spherical in form, it should be understood that they may be of various other forms suitable for particular massaging purposes.

The handles 11 are carried on opposite ends of a rod 16 rotatably journalled in the disks 12 on antifriction bearings 17. A finger of a hand grasping the handle 11 may hold the disk 12 and beads 15 from rotation about the axis of the rod 16, or may accommodate free rotatable movement of the disks 12 and massaging beads 15 to facilitate the massaging operation and reduce the effort required, as well as increase the areas of concentration of massage by enabling the pressure of the beads against the body to be varied without unduly increasing the pressure on the handles 11. It is, of course, understood that the beads 15 are always freely rotatable about the axes of the pins 13 except when the pressure may be great enough to frictionally engage the beads with each other as pressures on the handles 11 are varied. In most cases, however, it is advantageous that the beads freely rotate with respect to each other to reduce the strain of massaging.

It may, therefore, be understood that the massager or relaxing device just described can readily be used on any part of the body that can be reached, with as much or as little pressure required to do a thorough job and is particularly advantageous for massaging the abdominal regions of the body as well as the thighs.

The massager just described is useful for massaging and relaxing the neck as well as for reducing a double chin and tightening flabby muscles. It also may be used as a relaxer to induce sleep.

In the relaxer shown, the multiple freely movable rollers act like gently rippling waves over sore muscles and particularly tired feet. The device just described may also readily be rolled over and under the arch and around the ankle, to increase circulation where the muscles have been overworked and are painful.

I claim as my invention:

1. A massaging and relaxing device for stimulating and relaxing various parts of the body comprising a pair of spaced coaxial hand grips, a disk on the inside of each hand grip, means mounting said disks for free rotation with respect to said hand grips about a common axis, a plurality of rows of beads extending between said disks, each row being closely adjacent the other, and yieldable mounting means for said beads mounted at their ends on said disks and mounting said beads for free rotation with respect thereto and for flexible movement toward and from each other and flexing to conform said beads to the parts of the body between said hand grips and supporting said beads for rotation in an orbital path with sufficient flexibility to accommodate certain rows of beads to frictionally engage each other upon pressure on said hand grips to increase the massaging action of said beads.

2. The massaging and relaxing device of claim 1 in which the disks form bearing supports for said hand grips and a common rod coaxial with the axis of orbital movement of said beads forms a mounting means for said hand grips on said disks.

3. The massaging and relaxing device of claim 2 in which bearing support means support said disks on said rods on the inner sides of said hand grips and in which rotatable movement of said disks and orbital movement of said beads may be controlled to control the massaging effect by pressure on the peripheries of said disks by the fingers.

4. The massaging and relaxing device of claim 2 in which the bearing supports are anti-friction bearings, which form mountings for said disks on said rod, mounting said disks for free rotation with respect to said hand grips and thereby accommodating orbital movement of said beads about said rod, controlled by sufficient pressure to engage said beads with each other and by pressure by the fingers on selected of said disks.

* * * * *